US005178367A

United States Patent [19]

Vaughen

[11] Patent Number: 5,178,367

[45] Date of Patent: Jan. 12, 1993

[54] STRUCTURE FOR AN INFLATABLE LIFT DEVICE

[76] Inventor: Jack F. Vaughen, 26807 Spring Creek Rd., Rancho Palos Verdes, Calif. 90274

[21] Appl. No.: 556,359

[22] Filed: Jul. 23, 1990

[51] Int. Cl.[5] ..... B66F 3/24

[52] U.S. Cl. ..... 254/93 HP

[58] Field of Search ..... 254/93 HP, 93 R

[56] References Cited

U.S. PATENT DOCUMENTS 2,817,096 12/1957 Roth ..... 254/93 HP
3,523,679 8/1970 Clay ..... 254/93 HP

FOREIGN PATENT DOCUMENTS 2002611 7/1971 Fed. Rep. of Germany ... 254/93 HP
2802716 7/1979 Fed. Rep. of Germany ... 254/93 HP
1434806 5/1976 United Kingdom ..... 254/93 HP

*Primary Examiner*—Robert C. Watson

[57] ABSTRACT

In an inflatable lifting device comprising an upper platform to support a load, a lower base platform and a flexible, fluidtight diaphragm interposed between the two platforms for inflation to lift the load, the improvement comprising a diaphragm of truncated conical configuration. In some practices of the invention, two such diaphragms are effectively stacked on top of each other to increase the jacking height of the device. Constructuion of the conical diaphragm provides approximately uniform strength of the diaphragm around its entire periphery. Safety means are provided to prevent overpressurization of the diaphragm at its maximum lifting height. Means are also provided to prevent collapse of the loaded device in the event the fluid supply line should inadvertantly be disconnected.

37 Claims, 7 Drawing Sheets

FIG. 8.
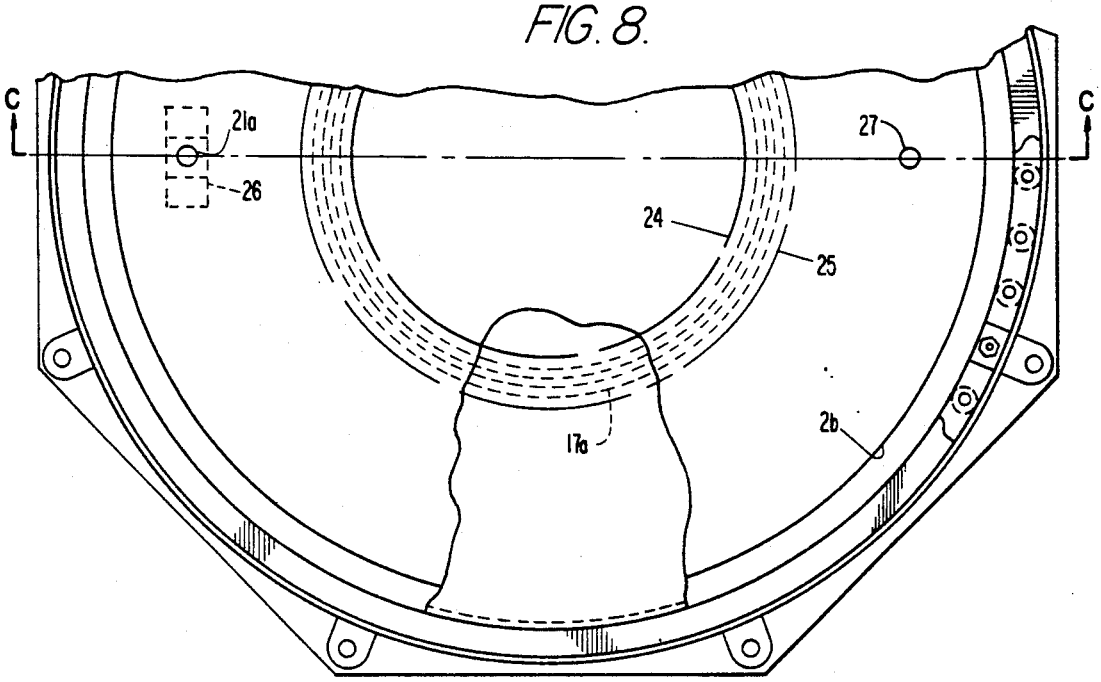
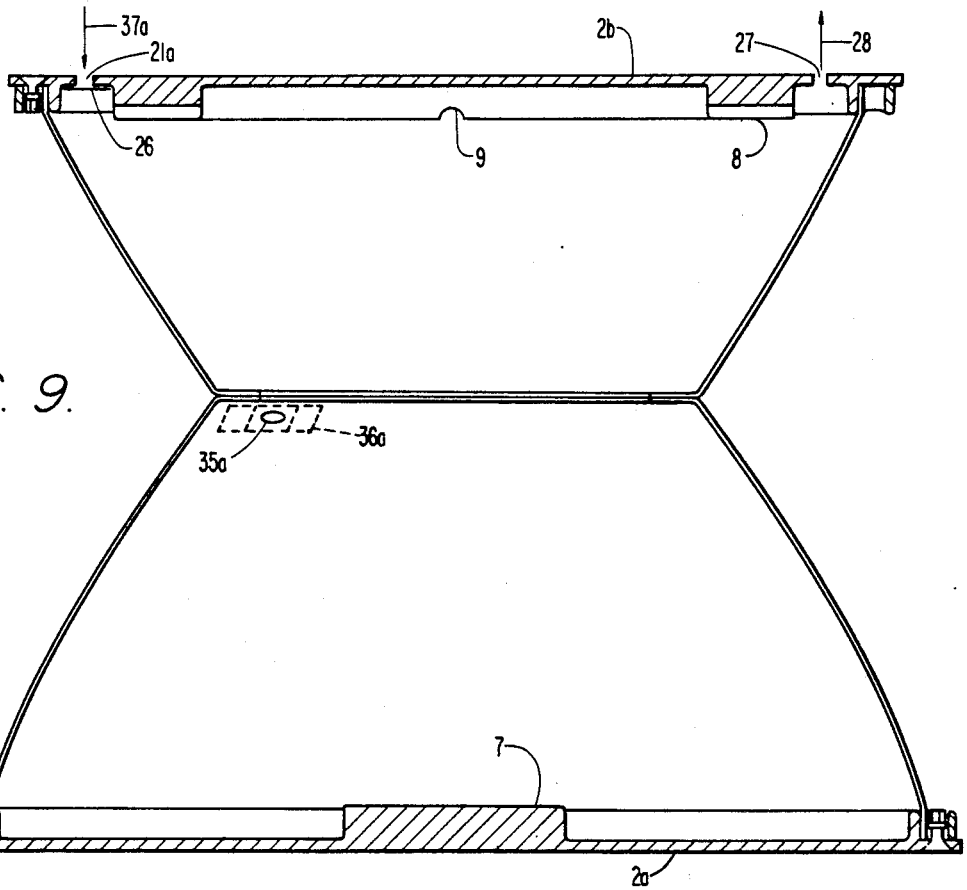
FIG. 9.

STRUCTURE FOR AN INFLATABLE LIFT DEVICE

CROSS REFERENCE TO PREVIOUSLY ISSUED PATENT

This application describes and claims a number of improvements over my previously issued patent Ser. No. 3,799,504 titled "Pneumatically Operated Lift Device" which issued on Mar. 26, 1974.

BACKGROUND OF THE INVENTION

The previously issued patent cross-referenced above explained the advantages of using a truncated conical inflatable diaphragm as the lifting element in an inflatable lifting device. Subsequent operating experience has proven the validity of the advantages claimed for this design.

The manufacture and use of these lifting devices has resulted in a number of innovations in the manufacture of the conical diaphragms and their mountings to adjacent structure. These improvements are described and claimed herein.

Operating experience has also demonstrated that lifting devices which employ a truncated conical diaphragm as their inflatable lifting element have a natural relationship between their transverse diametrical width and their maximum lifting height. Although the ratio of lifting height to width can be altered somewhat by changing slope of the truncated cone, precision of lifting height control decreases whenever slope of the cone is increased. These considerations effectively limit the practical lifting height available from any truncated conical diaphragm of a given transverse diameter. There are many applications for this type lifting device, however, where a greater jacking height would be desirable. This is accomplished in the present invention by effectively stacking one truncated cone on top of another to produce a "two-stage" truncated conical lifting diaphragm. This effectively doubles the jacking height available from a device of any given diameter.

One of the advantages of the type lifting device described is its low profile when deflated. This low profile results not only from the conical shape of the lifting diaphragm, but also from the flexibility of the assembled diaphragm. Normally the stronger a diaphragm is made, the greater its stiffness will be. It is a feature of this invention, however, that a multi-layer construction can be employed for the diaphragm to increase its strength without materially increasing its stiffness.

Since lifting devices of the type described are typically used to elevate massive loads, safety is a prime concern in their design. The invention described herein includes means to prevent the device from being overpressurized at its maximum lifting height. Means are also described which prevent a loaded device from descending uncontrollably in the event the supply line for lifting fluid becomes disconnected during operation.

SUMMARY OF THE INVENTION

In one practice of the invention an upper lifting platform is superimposed on a lower base platform and a circumferentially continuous diaphragm interconnects the two platforms to form therewith a chamber that may be inflated to lift the load. One of the circumferential edges of the diaphragm encompasses a relatively large area on one of the platforms and the other edge of the diaphragm defines a smaller area on the other of the two platforms, the two areas being symmetrical relative to each other. By virtue of this arrangement, the diaphragm inclines inwardly from one of the two platforms to the other and therefore tends to keep the lifting platform from shifting laterally relative to the base platform because on any diameter of the device the opposite inclined walls of the diaphragm oppose opposite horizontal shifts of the lifting platform. In addition, since the confined pressurized fluid exerts uniform pressure on the underside of the platform, the diaphragm tends to prevent tilting of the lifting platform as a result of the diaphragm's conical shape. Thus, the arrangement stabilizes the load and tends to elevate the load along a vertical lift axis.

In other practices of the invention, two truncated conical diaphragms are effectively stacked on top of each other to produce a "two-stage" lifting diaphragm interposed between a base plate and a load plate. This arrangement has the effect of doubling the jacking height for a given diameter of the device. Such two-stage diaphragms can be mounted with their smaller diameter circumferential edges attached together and their opposite, larger diameter edges attached to the base plate and load plate; or alternatively, their larger diameter circumferential edges may be attached together with their opposite, smaller diameter edges attached to the base plate and load plate.

In all configurations of the lifting device, the inflatable diaphragm consists of one or more truncated cones of fluidtight, flexible coated fabric. Construction of such truncated cones is described which produces approximately uniform radial strength of the cones around their entire periphery. To provide greater strength without increasing their stiffness, these truncated cones can be nested together to make a multi-layer diaphragm. In this configuration, radial overlap joints of the cones are staggered in azimuth to produce uniform strength around the entire periphery of the assembled diaphragm. In these multi-layer diaphragms, adjacent layers are attached to each other only at the inner and outer circumferential edges of the cones. This preserves the overall flexibility of the assembled diaphragm.

Two safety devices are described and claimed in the invention. A relief valve automatically vents lifting fluid from the interior of the lifting device whenever the device reaches its maximum lifting height. A check valve may also be mounted on the inlet port which admits fluid into the device to prevent rapid decompression of the loaded lifting device in the event the lifting fluid supply line should inadvertantly become disconnected.

BRIEF DESCRIPTION OF THE DRAWINGS

In the drawings, which are to be regarded as merely illustrative:

FIG. 8 is a partial planview of one inflatable lifting device with a two-stage truncated conical diaphragm.

FIG. 9 is a cross-sectional view of one inflatable lifting device comprising a two-stage truncated conical diaphragm mounted in fluid-tight manner between two nominally parallel platforms.

DESCRIPTION OF THE INVENTION

Figure 1:
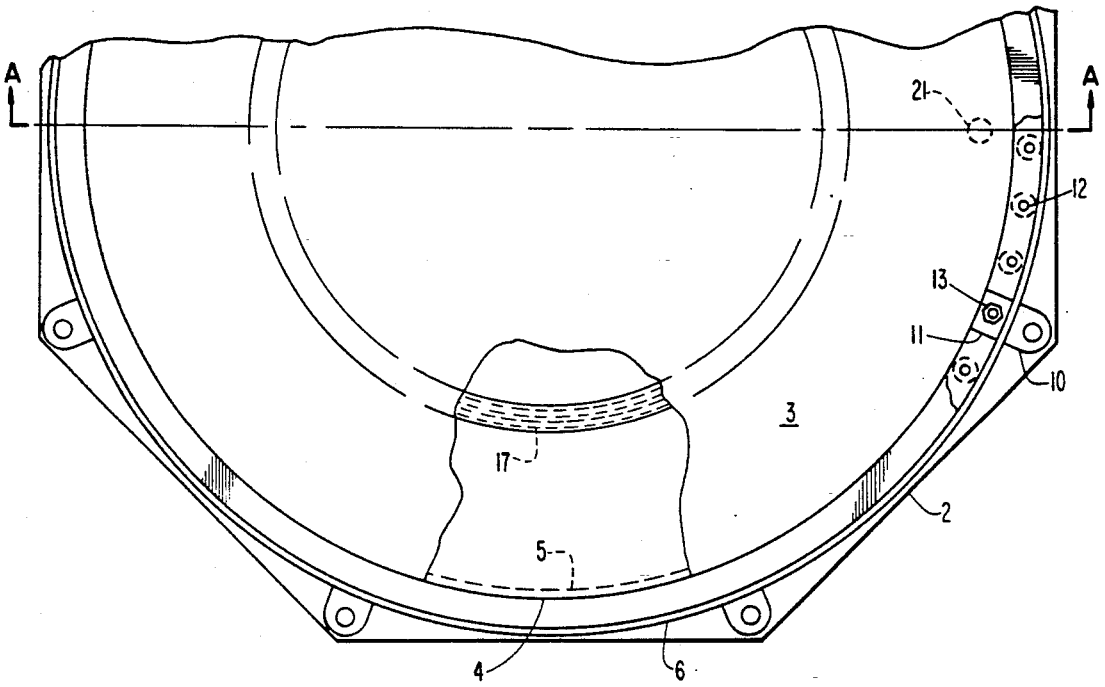
FIG. 1 is a partial planview of one inflatable lifting device having a single-stage truncated conical diaphragm.
Figure 2:
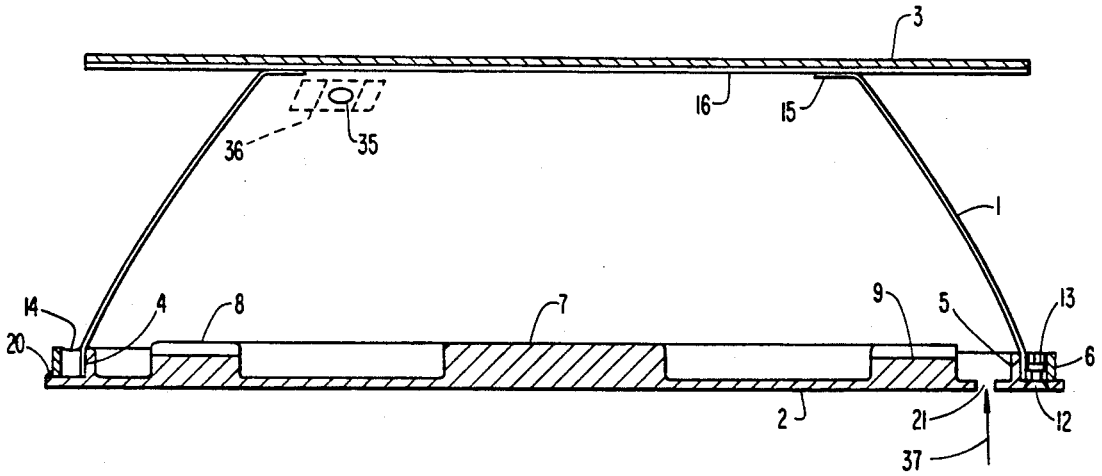
FIG. 2 is a cross-sectional view of one inflatable lifting device comprising a single-stage truncated conical diaphragm mounted in fluidtight manner between two nominally parallel platforms.

FIG. 1 is a partial planview and FIG. 2 is a diametrical cross-section through a single annular pressurized lifting device which constitutes the first embodiment of the invention. This device is shown in the fully inflated condition. A truncated conical diaphragm 1 forms a fluidtight flexible envelope between a first, lower base plate 2 and a second, upper load bearing plate 3. This load bearing plate may be of either rigid or flexible construction. A rigid plate might be made of metal for example while a flexible plate might be made of cloth-inserted rubber. This load bearing plate can have any planform shape but a circular plate is shown in FIG. 1. The larger diameter edge 4 of conical diaphragm 1 is attached by suitable fluidtight means to base platform 2. As shown in FIG. 2, an integral circumferential structural ridge 5 projects upward from the face of base 2. This ridge is preferably circular in planview as shown in FIG. 1. Outer edge 4 of conical diaphragm 1 is attached to the outer vertical surface of ridge 5 preferably by bonding. Ridge 5 is concentrically encompassed by ring 6 which is circular in planview and is of larger diameter than ridge 5. Both ridge 5 and ring 6 are preferably of less vertical height than the elevated portions 7 and 8 of base platform 2. Therefore, when the inflatable device is collapsed, the underside of load plate 3 rests on top of elevated portions 7, 8 of the base plate clearing both ridge 5 and ring 6. Note that the top surface of elevated angular portion 8 preferably has radial grooves 9 cut across its width to facilitate inflation when the lifting device is in its collapsed position. Also, note in FIG. 1 that outer ring 6 may be fitted with outward facing horizontal tabs 10 which have holes drilled through them (and on through base plate 2) to accomodate screws for attaching the inflatable lifting device to other structure. Outer ring 6 may also be fitted with a number of inward facing horizontal tabs 11 equally spaced around its inner periphery. Each of these tabs has a hole drilled through it to fit over an attaching screw 12. Each of these screws projects through base plate 2 and is flush mounted thereto so the screw head does not protrude beyond the face of the base plate. A nut 13 on each attaching screw 12 bears against the surface of each tab 11 to secure ring 6 against base plate 2. Typically, from eight to twelve attaching screws are used to attach the outer ring to the base plate. However, additional flush head screws are also installed in the annular space between ridge 5 and outer ring 6. These screws are typically spaced approximately one and one-half inches apart and are equally spaced circumferentially between tabs 11. No nuts are required on these intermediate screws. A fillet of suitable sealing material 20 is applied around the outer periphery of outer ring 6 where its edge bears against base plate 2. The base plate is then placed on a level surface and the annular cavity between ridge 5 and outer ring 6 is filled with rigid-setting plastic. This plastic material 14 unites the diaphragm, the base plate and the outer ring into one integral structural assembly after the plastic flows around the attaching screws and hardens. The inner edge 15 of conical diaphragm 1 is attached concentrically to a cloth disk 16. This attachment may be by vulcanizing; or alternatively, the parts may be bonded together and stitched by multiple concentric rows of stitches 17. If stitches are used, they should be sealed over inside the inflatable cavity to prevent leakage through the needle holes. Cloth disk 16 is then attached, preferably by bonding, to load plate 3 to complete the assembly. Lifting fluid can be introduced into the interior of the device as shown by arrow 18 through an inlet port 21. Inflation is preferably accomplished through a pressure regulating valve (not shown). Any suitable working fluid can be employed including air, steam, gas, water or oil.

Figure 3:
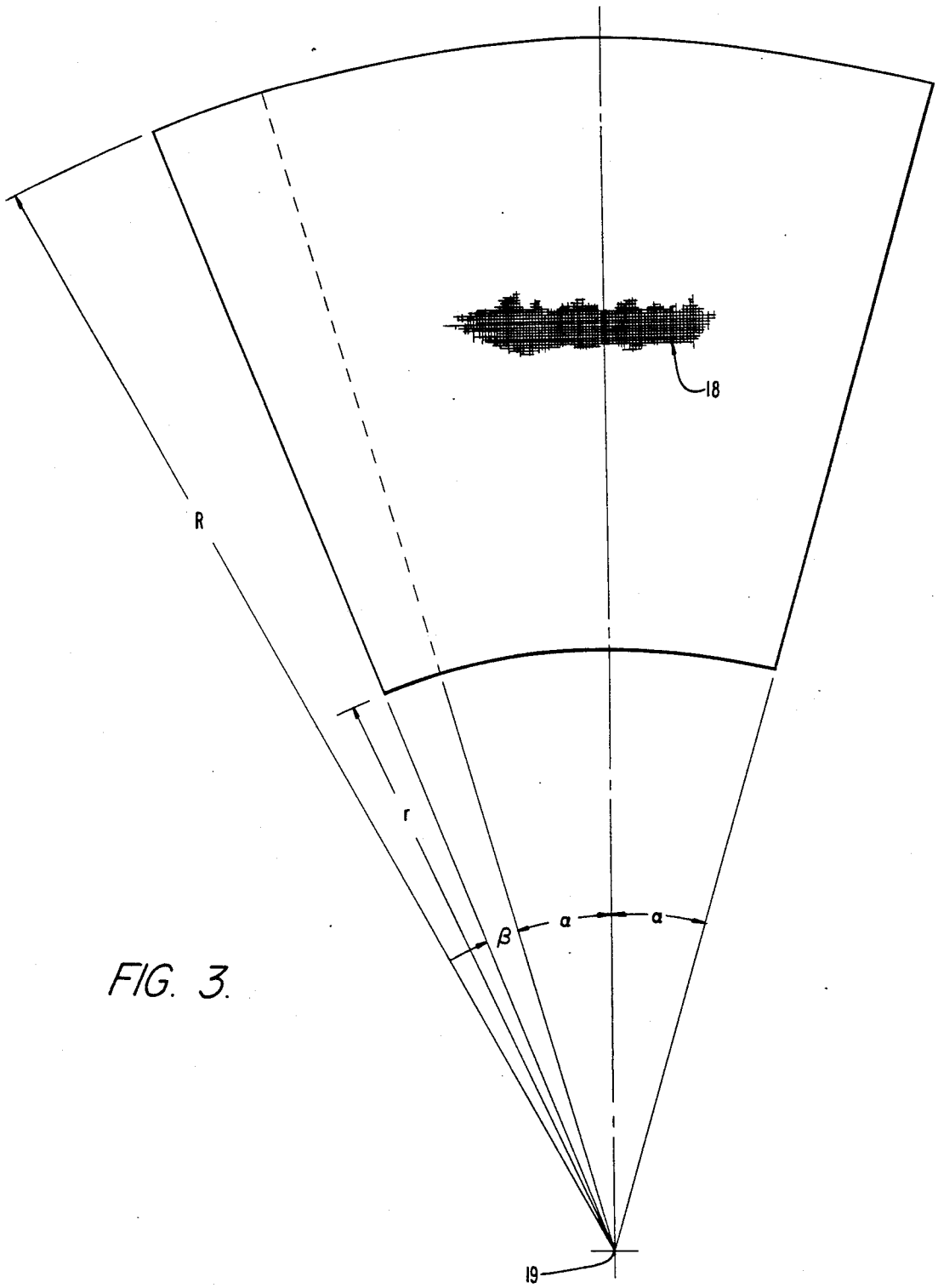
FIG. 3 is a flat pattern for one angular segment of a truncated conical diaphragm.
Figure 4:
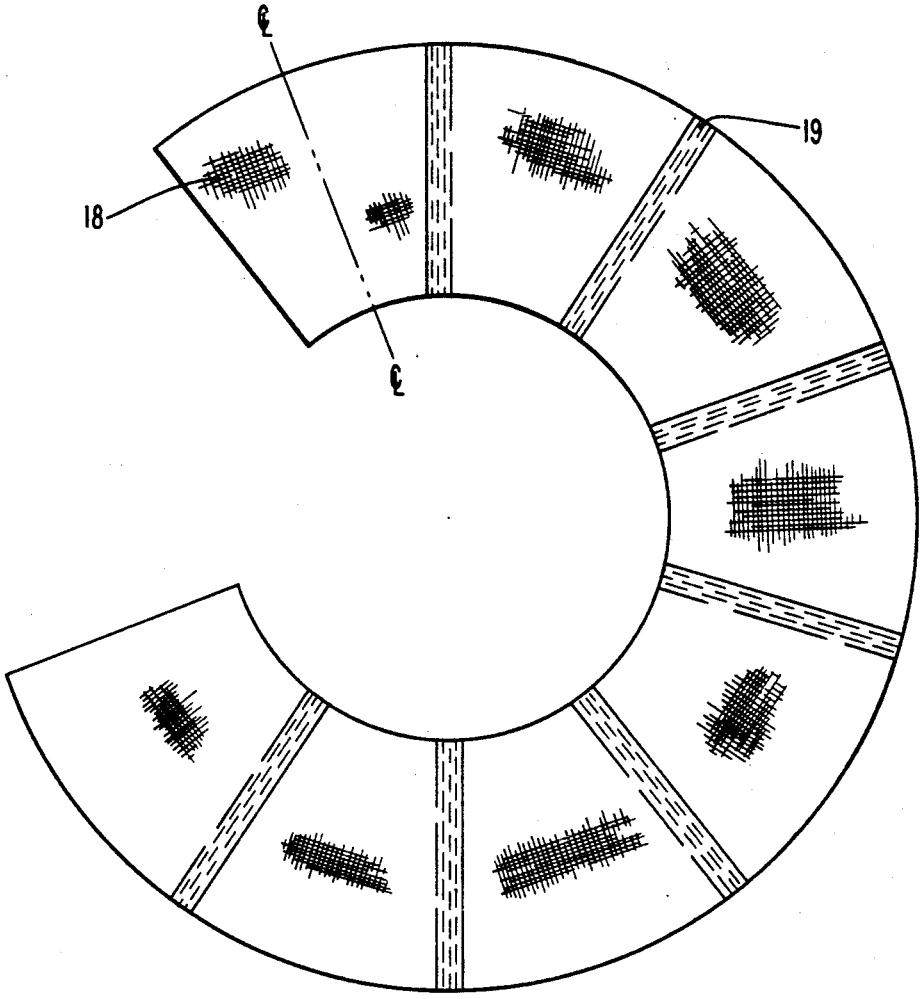
FIG. 4 is a flat pattern for one truncated conical diaphragm made up of a number of identical angular segments.
Figure 5:
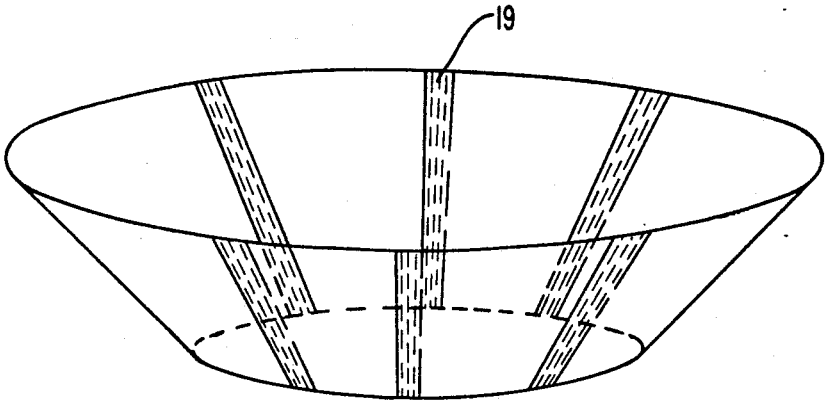
FIG. 5 is a perspective view of one assembled truncated conical diaphragm as it appears before attachment to adjacent structure.

Truncated conical diaphragm 1 is preferably constructed from a number of angular segments like that shown in FIG. 3. Each of these segments is cut from coated fabric with the threads 18 of the fabric oriented parallel and perpendicular to the center line of the segment. The curved edges of the segment are circular arcs having a common center 19. The inner edge has radius r and the outer edge has radius R as shown. The distance (R-r) is the radial width of the segment and becomes the slant height of the conical diaphragm when assembled. The angular width ($2\alpha$) of the segment determines how many segments are required to make up one conical diaphragm. The additional angular width ($\beta$) represents the area of overlap of the segments when they are assembled together. FIG. 4 is a flat pattern for one conical diaphragm showing how it is assembled from the angular segments of FIG. 3. These angular segments are overlapped along their radial edges and are attached together either by vulcanizing or by bonding and stitching. Bonded and stitched construction is shown in FIG. 4 with the segments attached together by multiple rows of radial stitches 19. To provide uniform radial strength of the diaphragm around its entire periphery, the threads 18 of each angular segment are oriented parallel and perpendicular to the center line of the segment as shown. FIG. 5 is a perspective view of the diaphragm of FIG. 4 showing the truncated conical form it takes after the edges of all segments are attached together. If stitches are used as shown, the stitches must be sealed on the inside of the diaphragm to prevent leakage through the needle holes. Note that the overlap areas of a cone constructed from angular segments in this manner extend the full radial width of the cone and have double the strength of the remainder of the cone. Since they are radially disposed in the cone and are evenly spaced around its periphery, these overlapped areas act as natural limit stops to establish the maximum inflation height of the cone.

Figure 6:
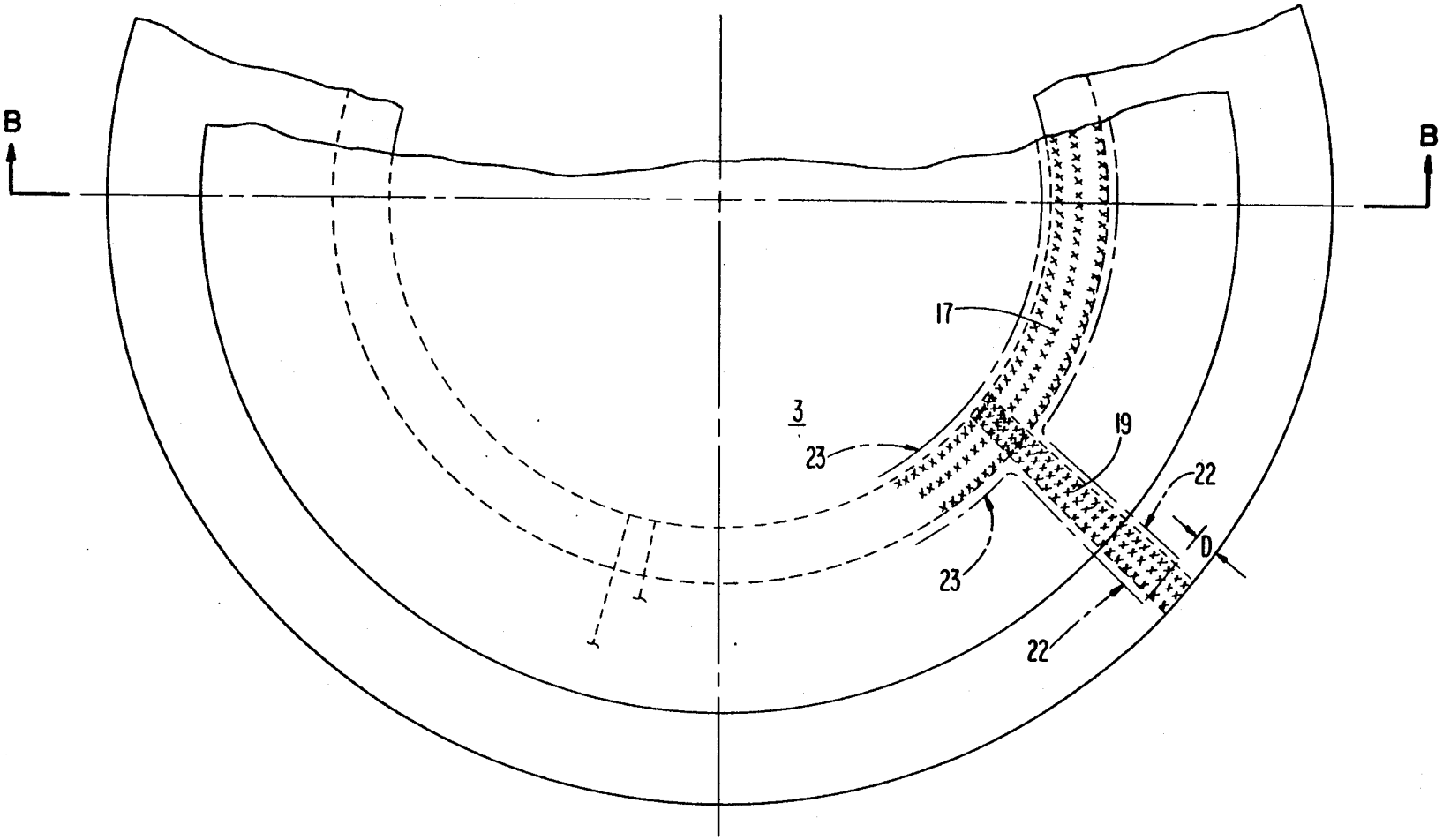
FIG. 6 is a partial planview of an assembled truncated conical diaphragm mounted to a load bearing plate.
Figure 7:
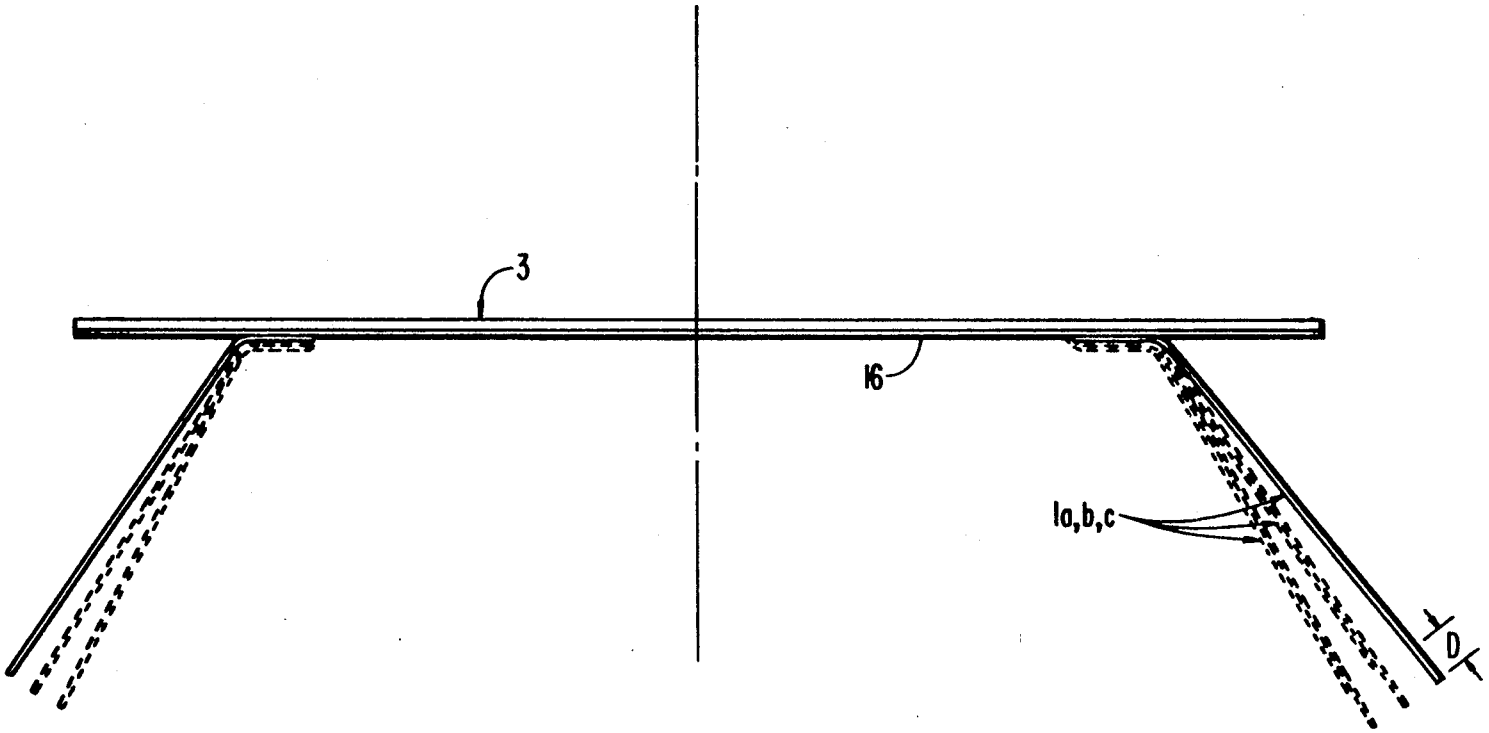
FIG. 7 is a cross-sectional view of one multi-layer truncated conical diaphragm assembly mounted to a load bearing plate.

FIG. 6 is a planview and FIG. 7 is a diametrical cross-sectional view of a multi-layer conical diaphragm 1 a,b,c and its cloth mounting disk 16 mounted to a load plate 3. All of the cloth parts are made of fluidtight coated fabric and may be attached together either by vulcanizing or by bonding and stitching. Stitched construction is indicated in FIG. 6 with both radial stitches 19 and circumferential stitches 17 shown in partial view. The radial stitches must be sealed from the inside of the diaphragm by covering them with a suitable sealing material between dashed boundry lines 22. Similarly, circumferential stitches 17 must be sealed from the inside of the diaphragm by covering them with a suitable sealing material between dashed boundary lines 23. This sealing material may be a thin, fluidtight plastic or rubber film for example, or it may be a chemical sealant such as room temperature vulcanizing rubber (RTV). In any case, all stitches should be covered so no leakage can occur through the needle holes. If multiple cones are nested together to form a multi-layer diaphragm as shown in FIG. 7, it is necessary to only seal the threads of the innermost cone. This prevents leakage from the interior of the diaphragm when inflated but allows trapped fluid to escape from between successive layers of the diaphragm by passout through their needle holes. Typically, when sealing the radial stitches 19 of the innermost cone, a small margin of width "D" along the outermost edge of the cone is protected from the sealing material. This facilitates later bonding of this outer edge to adjacent structure. If multiple cones are employed as shown in FIG. 7, the successive cones should be staggered in azimuth relative to each other so that the radial stitches of the entire assembly are equally spaced in azimuth like the spokes of a wheel (when seen in planview). This provides approximately uniform radial strength of the multi-layer cone assembly around its entire periphery while retaining maximum flexibility for the assembled diaphragm. It should also be noted that successive cones in this multi-layer construction are preferably attached to each other only by circumferential stitches 17 and by their peripheral mounting to adjacent structure at margin "D". Since the individual conical layers remain free of each other between these two concentric circumferential areas, the entire assembly maintains its flexibility. It is therefore capable of collapsing to a very low, flat profile when the diaphragm is deflated.

Because of the conical shape of the inflatable lifting diaphragm described above, there is a natural geometric relationship between the base diameter of the cone and its maximum inflated height. It is one of the advantages of a lifting device of this type that it spreads its lifting forces over a relatively large bearing area of its base and load plate. However, situations are sometimes encountered in application of these lifting devices where base mounting space is limited; or conversely, greater jacking height is desired. To accomodate such circumstances, it is possible to effectively stack two truncated cones on top of each other to double jacking height without increasing base plate diameter. FIG. 8 is a partial planview of such a "high lift" inflatable device and FIG. 9 is a diametrical cross-sectional view of the device. As shown in FIG. 9, this high-lift device essentially consists of two of the devices shown in FIG. 2 stacked on top of each other but with one of them inverted. When this is done, base plate 2*a* of the lower unit becomes the base plate for the entire assembly, while base plate 2*b* becomes the load plate for the high-lift device. The original load plate 3 and cloth mounting disk 16 of each of the devices shown in FIG. 2 can be eliminated in the high-lift device. The smallest diameter edges of the two conical diaphragms can be attached directly together as shown in FIG. 9. This may be done by vulcanizing or by bonding the circumferential marginal areas of the two cones together and sewing them with multiple concentric rows of stitches 17*a* as shown in FIG. 8. These stitches should be sealed on both sides between the inner circumferential edge of the overlap area 24 and its outer edge 25 as shown in FIG. 8. This "two-stage" high lift device can have virtually the same low collapsed height as the "single-stage" device shown in FIG. 2 if the diametrical size of downward-projecting portions of load plate 2*b* are made to not interfere with upward-projecting parts of base plate 2*a*. These parts can then nest concentrically with each other when the lifting device is collapsed. Fluid for inflating the two-stage lifting device can be admitted through port 21*a* as shown by arrow 18*a* in FIG. 9. This inflation fluid is preferably supplied through a pressure regulating valve (not shown). If desired, a simple check valve can be built into this inlet port by placing a strip of flexible, fluidtight material 26 over port 21*a* inside the device. This strip is bonded to the inside face of load plate 2*b* only near its ends as indicated by the dashed lines in FIG. 8. The central region of strip 26 is not bonded to plate 2*b* but simply lays over port 21*a*. Then whenever fluid is flowing in the direction indicated by arrow 18*a*, the central portion of strip 26 is pushed away from the surface of plate 2*b* by the incoming fluid which can then flow freely into the lifting device. However, if the inflation line should become disconnected from the device inadvertantly, fluid pressure inside the device will instantly press strip 26 against port 21*a* preventing flow outward through the port. This is an important safety feature because it prevents the loaded lift device from collapsing in the event the supply line should become disconnected. Of course, it is necessary that the lifting device collapse in a controlled manner whenever desired by the operator. This can be accomplished by adding a second port 27 which may be fitted with a simple gate valve (not shown) on the outside of the lift device. This gate valve can be opened by the operator at will and will allow fluid to exit the device as indicated by arrow 28. The rate at which fluid escapes (and the lifting device descends) depends on the setting of the gate valve chosen by the operator. Obviously, either one or both of ports 21*a* and 27 can be mounted in base plate 2*a* instead of in load plate 2*b* if desired.

Figure 10:
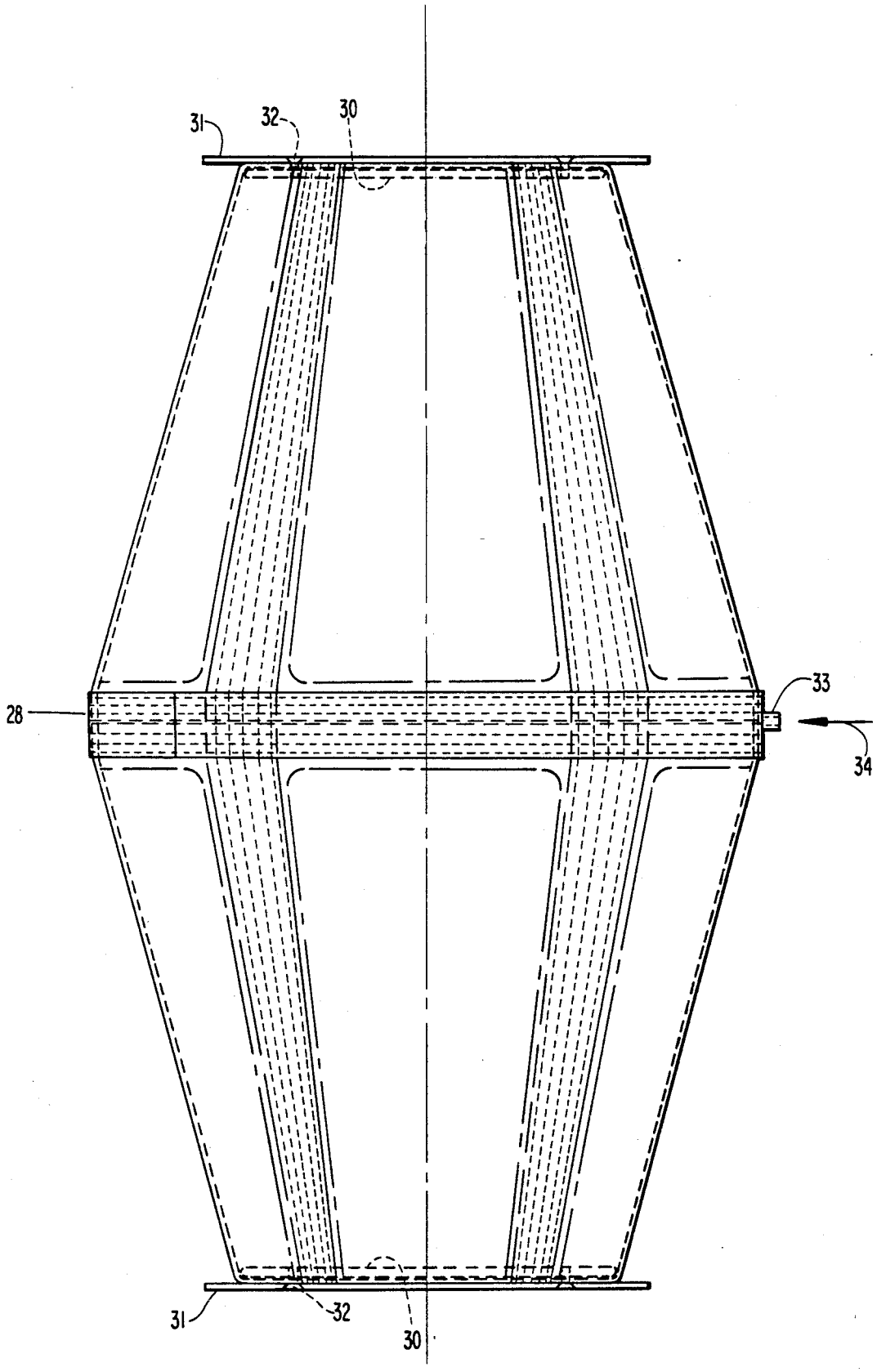
FIG. 10 is a cross-sectional view of an alternate configuration lifting device comprising a two-stage truncated conical diaphragm mounted in fluidtight manner between two nominally parallel platforms.

An alternate configuration for a two-stage high lift device is shown in FIG. 10. In this embodiment of the invention, two conical diaphragms of the type previously described are assembled with their largest diameter edges connected together. Each conical diaphragm consists of angular segments of coated fabric whose overlapped radial edges are bonded together, stitched and sealed. The marginal peripheral edges of the largest diameters of these conical diaphragms are spliced together by an encompassing band 28. This band is secured to the conical diaphragms by bonding, stitching and sealing in the manner previously described. Using a splicing band in this manner is preferable to simply attaching the conical diaphragms to each other because it minimizes the build up of overlapped layers of cloth in the attachment area, thereby preserving the flexibility of the assembled two-stage diaphragm. The smaller diameter circumferential edge of each conical diaphragm is folded over the peripheral edge of a spacer disk 30 and bonded thereto. A load plate 31 is then attached to the outside face of disk 30 preferably by a number of flush head screws 32 that are screwed into tapped holes in disk 30. Spacer disk 30 and load plate 31 are typically made of metal for maximum strength and durability. The construction shown in FIG. 10 produces an inflatable device with a high ratio of jacking height to base diameter. On the other hand, it also collapses to a very low profile when deflated. The two-stage diaphragm may be inflated through ports in either the base plate or the load plate in the manner previously described. Conversely, an inflation port 33 can be mounted directly in the wall of the diaphragm as shown. Inflation fluid can then be supplied through this port as indicated by arrow 34. This flow is preferably provided through a pressure regulating valve (not shown).

Since inflatable devices of the type described are used to lift massive loads, safety is a primary consideration in their design. A particular hazard is that they might be over-pressurized after they reach their full jacking height. In an extreme case, excessive pressure could explode the diaphragm causing the load to fall. To prevent such an accident, these devices can be fitted with bleed valves that automatically vent inflation fluid whenever the device reaches a maximum design height. As shown in FIG. 2, a port 35 may be placed in the wall of the conical diaphragm near the juncture of the diaphragm with the load plate. A rectangular strip of flexible, fluidtight coated fabric 36 is bonded to the outside surface of the diaphragm with its central portion covering port 35. Strip 36 is bonded to the wall of the diaphragm only near its outer ends as indicated by the dashed lines. Therefore, the central portion of strip 26 simply lays over port 35. So long as the lifting device is only partially inflated, pressure inside the diaphragm presses the upper region of the diaphragm against the underside of load plate 3. This effectively blocks outward flow of fluid through port 35. On the other hand, when the lifting device inflates to its full design height as shown in FIG. 2, port 35 peels away from the underside of load plate 3. Fluid can then flow outward through port 35 pushing strip 36 away far enough to allow the fluid to pass. If port 35 is larger than inlet port 21, it will be impossible to further increase pressure inside the lifting device thereby avoiding damage to the diaphragm. Another desirable feature of this type safety valve is that it typically produces an audible whistle or squeal whenever it passes fluid. This serves as a warning to the operator that he has exceeded the maximum intended lifting height. FIG. 9 shows a similar exit port **35*a* in the wall of a two-stage jack diaphragm. A strip 36*a* is mounted to the outside face of the diaphragm to cover the exit port. It is bonded to the surface of the diaphragm only near its ends as previously described. In this two-stage lifting device, adjoining peripheral portions of the upper and lower conical diaphragms press together whenever the lifting device is at less than its maximum jacking height. However, when the lifting device reaches its maximum height as shown in FIG. 9** the two parts of the diaphragm peel apart from each other clear to their circumferential attachment. The exit port can then pass fluid from the interior of the lifting device with the same results as previously described.

I claim:

1. In a device to lift a load comprising:

a base platform for positioning below the load, a lifting platform overlaying the base platform, and truncated conical diaphragm means interposed between the two platforms and attached to the two platforms in fluidtight manner for inflation to raise the lifting platform, means to bleed fluid from the enclosed space between the two platforms including;

at least one port in the wall of the conical diaphragm positioned near one edge of said diaphragm, and a rectangular sheet of flexible, fluidtight material positioned with its central portion covering said port and its outer portions attached to the outer surface of said diaphragm on opposite sides of said port, wherein said port is closed off by said sheet whenever said diaphragm is pressed against the face of the adjacent platform but allows fluid to flow between said sheet and said diaphragm outward through said port whenever said sheet is not pressed against said platform.

2. Bleed means as described in claim 1 wherein the leakage area of all said exit ports is greater than the area of the inlet port which supplies pressurized fluid to inflate the diaphragm.

3. In an inflatable lifting device which is pressurized through at least one inlet port, check valve means to prevent back flow through said inlet port comprising;

a rectangular sheet of flexible, fluidtight material positioned with its central portion covering said port and its outer portions attached to the inner surface of the structure through which the port opens, wherein said sheet allows fluid to flow through said port into the interior of the lift device but blocks flow from the interior of the device outward through the port.

4. An inflatable lifting device having an inlet port fitted with a check valve as described in claim 3 plus a second, exit port fitted with a gate valve for controlled deflation of the lifting device.

5. In a device to lift a load comprising:

a base platform for positioning below the load, a lifting platform overlaying the base platform, and diaphragm means interposed between the two platforms and attached to the two platforms in fluidtight manner for inflation to raise the lifting platform, spacer means to protect the diaphragm by limiting the approach of the lifting platform to the base platform when the diaphragm is deflated, said spacer means having grooves in its horizontal surface to facilitate cross flow of lifting fluid past said spacer means when the load platform is resting on top of said spacer means.

6. Spacer means as described in claim 5 which project upward from the base platform.

7. Spacer means as described in claim 5 which project downward from the load platform.

8. Spacer means as described in claim 5 projecting downward from the load platform and projecting upward from the base platform, said spacer means being of annular configuration concentric with each other and having different contiguous diameters to clear each other when the lifting diaphragm deflates allowing the load platform to rest on the base platform.

9. In a device to lift a load comprising:

a base platform for positioning below the load, a lifting platform overlaying the base platform, and truncated conical diaphragm means interposed between the two platforms and attached to the two platforms in fluidtight manner for inflation to raise the lifting platform, said truncated conical diaphragm comprising an annular flexible sheet wall made of angular segments of fluidtight, coated, woven fabric in which threads of each segment are oriented parallel and perpendicular to the radial center line of the segment, and adjacent segments are overlapped along their radial edges and attached together in fluidtight manner.

10. A truncated conical diaphragm as described in claim 9 wherein said attachment of radial overlapped edges includes;

bonding of adjacent segments together in their overlapped areas, stitching through each bonded connection with multiple rows of stitches, and sealing over the stitches on the inside surface of the truncated cone to prevent leakage of fluid through the needle holes of the stitches.

11. A truncated conical diaphragm as described in claim 9 wherein said attachment of radial overlapped edges is by vulcanizing.

12. In a device to lift a load comprising:

a base platform for positioning below the load, a lifting platform overlaying the base platform, and truncated conical diaphragm means interposed between the two platforms and attached to the two platforms in fluidtight manner for inflation to raise the lifting platform, one continuous edge of said truncated conical diaphragm attached concentrically to a disk of fluidtight coated fabric by bonding, stitching through the bonded connection with multiple concentric rows of stitches and sealing over the stitches on the inside of the cone to prevent leakage through the needle holes of the stitches, said fabric disk then bonded to the inside surface of one of said two platforms.

13. In a device to lift a load comprising:

a base platform for positioning below the load, a lifting platform for overlaying the base platform, and truncated conical diaphragm means interposed between the two platforms and attached to the two platforms in fluidtight manner for inflation to raise the lifting platform, one continuous edge of said truncated conical diaphragm attached concentrically to a disk of fluidtight coated fabric by vulcanizing, said fabric disk then bonded to the inside surface of one of said two platforms.

14. In a device to lift a load comprising:

a base platform for positioning below the load, a lifting platform overlaying the base platform, and truncated conical diaphragm means interposed between the two platforms and attached to the two platforms in fluidtight manner for inflation to raise the lifting platform, one continuous edge of said truncated conical diaphragm bonded to an annular structural ridge projecting from the inside face of said base plate, said assembly encompassed by an annular cylindrical structural ring of larger diameter than said ridge which is fixedly mounted to the base plate, said ring attached by a number of equally spaced flush-head screws projecting through the planar portion of the base plate into an annular space between said structural ridge and said ring, additional equally spaced flush-head screws also projecting through the planar portion of the base plate into said annular space, and said annular space filled with rigid-setting plastic material to unite the diaphragm, the base plate and the ring into one integral structural assembly.

15. In a device to lift a load comprising:

a base platform for positioning below the load, a lifting platform overlaying the base platform, and truncated conical diaphragm means interposed between the two platforms and attached to the two platforms in fluidtight manner for inflation to raise the lifting platform, said conical diaphragm means consisting of multiple truncated cones of identical size nested together, each said truncated cone comprising an annular flexible sheet wall made of angular segments of fluidtight, coated fabric with adjacent segments overlapped along their radial edges and attached together in fluidtight manner, said nested cones indexed in azimuth relative to each other to equally space their radial overlapped joints around the periphery of the diaphragm.

16. Multiple nested truncated conical diaphragms as set forth in claim 15 wherein said fluidtight attachment of overlapped adjacent segments consists of bonding and stitching said overlapped areas, the stitches of only the innermost cone being sealed to prevent leakage of fluid therethrough.

17. In a device to lift a load comprising:

a base platform for positioning below the load, a lifting platform overlaying the base platform, and dual truncated conical diaphragm means interposed between the two platforms and attached to the platforms in fluidtight manner for inflation to raise the lifting platform, wherein a first continuous edge of a first truncated conical diaphragm is attached to one of the two platforms and defines a first area thereon, a first continuous edge of a second truncated conical diaphragm is attached to the second platform and defines a second area thereon, the second continuous edges of both said truncated conical diaphragms being attached together in fluidtight manner to define an area generally smaller than the areas of attachment to the load plate and base plate and positioned substantially symmetrically thereof with the outer circumferential walls of the two diaphragms projecting from and sloping radially inwardly of the two platforms to the common area of attachment of the two diaphragms, means to bleed fluid from the enclosed space between the two platforms comprising:

at least one port in the wall of the conical diaphragm positioned near said second continuous edge of said diaphragm, and a rectangular sheet of flexible, fluidtight material positioned with its central portion covering said port and its outer portions attached to the outer surface of said diaphragm on opposite sides of said port, wherein said port is closed off by said sheet whenever said diaphragm is pressed against the surface of the adjacent diaphragm but allows fluid to flow between said sheet and said diaphragm outward through said port whenever said sheet is not pressed against the adjacent diaphragm.

18. Bleed means as described in claim 17 wherein the leakage area of all said exit ports is greater than the area of the inlet port which supplies pressurized fluid to inflate the diaphragm.

19. In a device to lift a load comprising:

a base platform for positioning below the load, a lifting platform overlaying the base platform, and dual truncated conical diaphragm means interposed between the two platforms and attached to the platforms in fluidtight manner for inflation to raise the lifting platform, wherein a first continuous edge of a first truncated conical diaphragm is attached to one of the two platforms and defines a first area thereon, a first continuous edge of a second truncated conical diaphragm is attached to the second platform and defines a second area thereon, the second continuous edges of both said truncated conical diaphragms being attached together in fluidtight manner to define an area generally smaller than the areas of attachment to the load plate and base plate and positioned substantially symmetrically thereof with the outer circumferential walls of the two diaphragms projecting from and sloping radially inwardly of the two platforms to the common area of attachment of the two diaphragms, each said truncated conical diaphragm comprising an annular flexible sheet wall made of angular segments of fluidtight, coated, woven fabric in which threads of each segment are oriented parallel and perpendicular to the radial center line of the segment, and adjacent segments are overlapped along their radial edges and attached together in fluidtight manner.

20. A truncated conical diaphragm as described in claim 19 wherein said attachment of radial overlapped edges includes, bonding of adjacent segments together in their overlapped areas, stitching through each bonded connection with multiple rows of stitches, and sealing over the stitches on the inside surface of the truncated cone to prevent leakage of fluid through the needle holes of the stitches.

21. A truncated conical diaphragm as described in claim 19 wherein said attachment of radial overlapped edges is by vulcanizing.

22. In a device to lift a load comprising:

a base platform for positioning below the load, a lifting platform overlaying the base platform, and dual truncated conical diaphragm means interposed between the two platforms and attached to the platforms in fluidtight manner for inflation to raise the lifting platform, wherein a first continuous edge of a first truncated conical diaphragm is attached to one of the two platforms and defines a first area thereon, a first continuous edge of a second truncated conical diaphragm is attached to the second platform and defines a second area thereon, the second continuous edges of both said truncated conical diaphragms being attached together in fluidtight manner to define an area generally smaller than the areas of attachment to the load plate and base plate and positioned substantially symmetrically thereof with the outer circumferential walls of the two diaphragms projecting from and sloping radially inwardly of the two platforms to the common area of attachment of the two diaphragms, said second continuous edges of the truncated conical diaphragms attached together in fluidtight manner by bonding, stitching through the bonded connection with multiple concentric rows of stitches and sealing over the stitches on the inside surface of the cones.

23. In a device to lift a load comprising:

a base platform for positioning below the load, a lifting platform overlaying the base platform, and dual truncated conical diaphragm means interposed between the two platforms and attached to the platforms in fluidtight manner for inflation to raise the lifting platform, wherein a first continuous edge of a first truncated conical diaphragm is attached to one of the two platforms and defines a first area thereon, a first continuous edge of a second truncated conical diaphragm is attached to the second platform and defines a second area thereon, the second continuous edges of both said truncated conical diaphragms being attached together in fluidtight manner to define an area generally smaller than the areas of attachment to the load plate and base plate and positioned substantially symmetrically thereof with the outer circumferential walls of the two diaphragms projecting from and sloping radially inwardly of the two platforms to the common area of attachment of the two diaphragms, said second continuous edges of the truncated conical diaphragms attached together in fluidtight manner by vulcanizing.

24. In a device to lift a load comprising:

a base platform for positioning below the load, a lifting platform overlaying the base platform, and dual truncated conical diaphragm means interposed between the two platforms and attached to the platforms in fluidtight manner for inflation to raise the lifting platform, wherein a first continuous edge of a first truncated conical diaphragm is attached to one of the two platforms and defines a first area thereon, a first continuous edge of a second truncated conical diaphragm is attached to the second platform and defines a second area thereon, and the second continuous edges of both said truncated conical diaphragms are attached together in fluidtight manner, said first continuous edge of each truncated conical diaphragm attached to an annular structural ridge projecting from the inside face of one platform, said attachment encompassed by an annular cylindrical structural ring of larger diameter than said ridge which is fixedly mounted to the platform and has vertical height less than height of the spacer means of the platform, said ring attached by a number of equally spaced flush-head screws projecting through the planar portion of the platform into an annular space between said structural ridge and said ring, additional equally spaced flush-head screws also projecting through the planar portion of the platform into said annular space and said annular space filled with rigid-setting plastic material to unite the diaphragm, the platform and the ring into one integral structural assembly.

25. In a device to lift a load comprising:

a base platform for positioning below the load,
a lifting platform overlaying the base platform, and
dual truncated conical diaphragm means interposed between the two platforms and attached to the platforms in fluidtight manner for inflation to raise the lifting platform, wherein
a first continuous edge of a first truncated conical diaphragm is attached to one of the two platforms and defines a first area thereon,
a first continuous edge of a second truncated conical diaphragm is attached to the second platform and defines a second area thereon, and
the second continuous edges of both said truncated conical diaphragms are attached together in fluidtight manner,
each said truncated conical diaphragm comprised of multiple truncated cones of identical size nested together,
each said truncated cone comprising an annular flexible sheet wall made of angular segments of fluidtight, coated fabric with adjacent segments overlapped along their radial edges and attached together in fluidtight manner,
said truncated cones indexed in azimuth relative to each other to equally space their radial overlapped joints around the periphery of the diaphragm.

26. Multiple nested truncated conical diaphragms as set forth in claim 25 wherein the stitches of only the innermost cone are sealed to prevent leakage of fluid therethrough.

27. In a device to lift a load comprising:
a base platform for positioning below the load,
a lifting platform overlaying the base platform, and
dual truncated conical diaphragm means interposed between the two platforms and attached to the platforms in fluidtight manner for inflation to raise the lifting platform, wherein
a first continuous edge of a first truncated conical diaphragm is attached to one of the two platforms and defines a first area thereon,
a first continuous edge of a second truncated conical diaphragm is attached to the second platform and defines a second area thereon,
the second continuous edges of both said truncated conical diaphragms being attached together in fluidtight manner to define an area generally larger than the areas of attachment to the two platforms and positioned substantially symmetrically thereof with the outer circumferential walls of the two diaphragms projecting from and sloping radially outwardly of the two platforms to the common area of attachment of the two diaphragms,
means to bleed fluid from the enclosed space between the two platforms comprising:
at least one port in the wall of the conical diaphragm positioned near said first continuous edge of said diaphragm, and
a rectangular sheet of flexible, fluidtight material positioned with its central portion covering said port and its outer portions attached to the outer surface of said diaphragm on opposite sides of said port, wherein
said port is closed off by said sheet whenever said diaphragm is pressed against the face of the adjacent platform but allows fluid to flow between said sheet and said diaphragm outward through said port whenever said sheet is not pressed against said platform.

28. Bleed means as described in claim 27 wherein the leakage area of all said exit ports is greater than the area of the inlet port which supplies pressurized fluid to inflate the diaphragm.

29. In a device to lift a load comprising:
a base platform for positioning below the load,
a lifting platform overlaying the base platform, and
dual truncated conical diaphragm means interposed between the two platforms and attached to the platforms in fluidtight manner for inflation to raise the lifting platform, wherein
a first continuous edge of a first truncated conical diaphragm is attached to one of the two platforms and defines a first area thereon,
a first continuous edge of a second truncated conical diaphragm is attached to the second platform and defines a second area thereon,
the second continuous edges of both said truncated conical diaphragms being attached together in fluidtight manner to define an area generally larger than the areas of attachment to the two platforms and positioned substantially symmetrically thereof with the outer circumferential walls of the two diaphragms projecting from and sloping radially outwardly of the two platforms to the common area of attachment of the two diaphragms,
said first continuous edge of said first truncated conical diaphragm attached to one of the two platforms by bonding and clamping between said platform and spacer means comprising a structural disk of smaller diameter than said platform and positioned concentrically thereto, and
said first continuous edge of said second truncated conical diaphragm attached to the other of the two platforms by bonding and clamping between said platform and spacer means comprising a structural disk of smaller diameter than said platform and positioned concentrically thereto.

30. In a device to lift a load comprising:
a base platform for positioning below the load,
a lifting platform overlaying the base platform, and
dual truncated conical diaphragm means interposed between the two platforms and attached to the platforms in fluidtight manner for inflation to raise the lifting platform, wherein
a first continuous edge of a first truncated conical diaphragm is attached to one of the two platforms and defines a first area thereon,
a first continuous edge of a second truncated conical diaphragm is attached to the second platform and defines a second area thereon,
the second continuous edges of both said truncated conical diaphragms being attached together in fluidtight manner to define an area generally larger than the areas of attachment to the two platforms and positioned substantially symmetrically thereof with the outer circumferential walls of the two diaphragms projecting from and sloping radially outwardly of the two platforms to the common area of attachment of the two diaphragms,
said second continuous edge of said first truncated conical diaphragm attached in fluidtight manner to one marginal portion of an encompassing band of flexible, fluidtight material,
said second continuous edge of said second truncated conical diaphragm attached in fluidtight manner to an adjacent marginal portion of said encompassing band.

31. Adjacent continuous edges of two truncated conical diaphragms as described in claim 30 attached by vulcanizing to a common encompassing band of flexible, fluidtight material.

32. Adjacent continuous edges of two truncated conical diaphragms as described in claim 30 attached to a common encompassing band of flexible, fluidtight material by bonding overlapping areas together, stitching through the bonded area with multiple circumferential rows of stitches and sealing the inside surface of the assembly to prevent fluid leakage therethrough.

33. In a device to lift a load comprising:

a base platform for positioning below the load, a lifting platform overlaying the base platform, and dual truncated conical diaphragm means interposed between the two platforms and attached to the platforms in fluidtight manner for inflation to raise the lifting platform, wherein a first continuous edge of a first truncated conical diaphragm is attached to one of the two platforms and defines a first area thereon, a first continuous edge of a second truncated conical diaphragm is attached to the second platform and defines a second area thereon, the second continuous edges of both said truncated conical diaphragms being attached together in fluidtight manner to define an area generally larger than the areas of attachment to the two platforms and positioned substantially symmetrically thereof with the outer circumferential walls of the two diaphragms projecting from and sloping radially outwardly of the two platforms to the common area of attachment of the two diaphragms, each said truncated conical diaphragm comprising an annular flexible sheet wall made of angular segments of fluidtight, coated, woven fabric in which threads of each segment are oriented parallel and perpendicular to the radial center line of the segment, and adjacent segments are overlapped along their radial edges and attached together in fluidtight manner.

34. A truncated conical diaphragm as described in claim 33 wherein said attachment of radial overlapped edges includes;

bonding of adjacent segments together in their overlapped areas, stitching through each bonded connection with multiple rows of stitches, and sealing over the stitches on the inside surface of the truncated cone to prevent leakage of fluid through the needle holes of the stitches.

35. A truncated conical diaphragm as described in claim 33 wherein said attachment of radial overlapped edges is by vulcanizing.

36. Multiple nested truncated conical diaphragms as set forth in claim 18 wherein said diaphragms are attached to each other only along their peripheral edges where they also attach to the base platform and the lifting platform of the lifting device.

37. Multiple nested truncated conical diaphragms as set forth in claim 25 wherein said diaphragms are attached to each other only along their peripheral edges where they also attach to the base platform and the lifting platform of the lifting device, and along their peripheral edges where they also attach the dual truncated cones together.

* * * * *

UNITED STATES PATENT AND TRADEMARK OFFICE

CERTIFICATE OF CORRECTION

PATENT NO. : 5,178,367

DATED : January 12, 1993

INVENTOR(S) : Jack F. Vaughen

It is certified that error appears in the above-indentified patent and that said Letters Patent is hereby corrected as shown below:

Column 16, line 23 "18" should read --15--.

Signed and Sealed this

Twenty-eighth Day of December, 1993

*Attest:*

Bruce Lehman

BRUCE LEHMAN

*Attesting Officer*

*Commissioner of Patents and Trademarks*